United States Patent [19]

Schuessler et al.

[11] 4,081,772

[45] Mar. 28, 1978

[54] MOVING CONTACT TERMINALS FOR RELAYS

[75] Inventors: John C. Schuessler, West Covina; David J. Tapp, Manhattan Beach, both of Calif.

[73] Assignee: Leach Corporation, Los Angeles, Calif.

[21] Appl. No.: 669,214

[22] Filed: Mar. 22, 1976

[51] Int. Cl.[2] ..... H01H 1/50

[52] U.S. Cl. ..... 335/200; 335/128; 335/193

[58] Field of Search ..... 335/128, 200, 191, 192, 335/193, 194, 274

[56] References Cited

U.S. PATENT DOCUMENTS 3,484,729 12/1969 Adams et al. ..... 335/200

*Primary Examiner*—Harold Broome

*Attorney, Agent, or Firm*—Christie, Parker & Hale

[57] ABSTRACT

An arrangement for providing an electrical current path between a connector pin in the header of a relay and the moving contacts in which a bracket is attached to the side of the connector pin and is bifurcated so as to extend on either side of the connector pin. A U-shaped spring member has one leg bifurcated to straddle the connector pin and engage the bracket in a knife-edge contact. The other leg of the U-shaped spring member engages the moving contact support in a knife-edge connection, allowing pivoting movement of the moving contacts relative to the connector pin.

5 Claims, 5 Drawing Figures

MOVING CONTACT TERMINALS FOR RELAYS

FIELD OF THE INVENTION

This invention relates to electrical relays, and more particularly, is concerned with a high performance electromechanically operated relay of highly compact design.

BACKGROUND OF THE INVENTION

High performance relays are utilized in great numbers in the aircraft, aerospace, and electronics industries in which a premium is placed on minimum weight and physical size for operation under extreme environmental conditions and with high electrical capacities. Relays capable of switching currents of 10 amperes or more at switching times of less than a millisecond and occupying a total volume of less than 7 cubic centimeters make the design and manufacture of the relay parts extremely critical and expensive. In attempting to scale down the size of component parts to reduce the weight and size of the relay, careful attention must be given to strengths of materials in order to withstand shocks of up to 200 g's, vibrations of up to 50 g's, and at the same time the relay must provide minimum contact resistance, as well as sufficient insulation and spacing to prevent voltage breakdown and arcing.

Such high performance relays are constructed so that the entire relay assembly, including the relay motor and the switches operated by the relay motor, are hermetically sealed. All the electrical connections to the switch contacts as well as to the electromagnetic motor are made through a group of connector pins which pass through a header, the pins being mounted in the header by glass or ceramic seals.

One arrangement for providing electrical connection between a contact pin and the moving switch contacts of the relay is shown in U.S. Pat. No. 3,484,729. This patent discloses an arrangement in which a bracket welded to the end of the contact pin extends parallel to a pivotally supported blade to which the moving contacts are attached. A flat spring formed in a compressed U-shape is positioned between the bracket and the blade, the ends of the U-shaped spring being bent outwardly to pivotally engage respectively the bracket and the center of the blade. The spring action holds the U-shaped contact spring in place with a minimum of load restricting the motion of the blade by the relay.

However, this arrangement results in a rather wide spacing between the header and the contact blade. As a result, the ends of the contact blade supporting the moving contacts must be offset to move the contacts closer to the header. Also, the contact pin in this arrangement must be offset relative to the pivot axis at the center of the contact blade to allow room for the bracket and U-shaped spring.

SUMMARY OF THE INVENTION

The present invention is directed to an improved electrical relay which is substantially more compact. Specifically, the present invention is directed to an improved arrangement for providing an electrical connection between the moving contact supporting blade and the contact pins. The arrangement of the present invention permits the space between the header and the switch contacts to be substantially reduced. This is accomplished in brief by providing a relay in which the moving contacts are supported on the end of a flat contact blade supported on the armature of the relay and pivoted adjacent the center. A header extends parallel to and in closely spaced relation to the moving contact blade. A connector pin at the center of the header is aligned with the center of the contact blade. An E-shaped bracket has the outer end of the center leg bent 90° and attached to the side of the contact pin with the outer legs straddling the pin at a point intermediate the header and the end of the pin. A U-shaped spring member has one leg bifurcated. The ends of the bifurcated leg pivotally engage the outer legs of the bracket on either side of the pin while the other leg of the U-shaped spring pivotally engages the contact blade.

DESCRIPTION OF THE DRAWINGS

For a more complete understanding of the invention reference should be made to the accompanying drawings, wherein.

DETAILED DESCRIPTION

Figure 2:
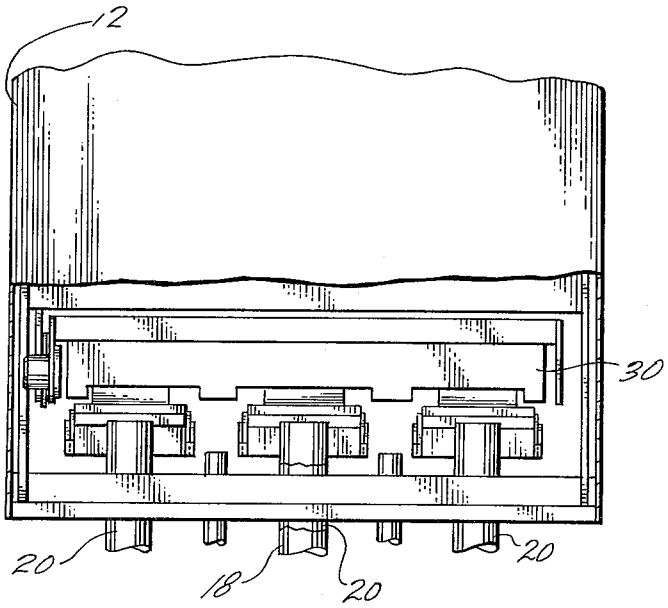
FIG. 2 is a partial end view of the relay of FIG. 1.

Referring to the drawings in detail, the numeral 10 indicates generally a relay of the type described in detail in copending application Ser. No. 669,217, filed Mar. 22, 1976, entitled "Improved Electromagnetic Actuator for a Relay", and assigned to the same assignee as the present invention. The relay includes an outer cover 12 which is placed over the relay mechanism after assembly and which is hermetically sealed to a base or header 14. The header is provided with a plurality of contact pins, such as indicated at 16, 18 and 20, which pass through the header and are hermetically sealed to the header by glass seals (not shown). The pins project into the interior of the relay with the outermost pins 16 and 20 providing direct support for the fixed contacts 22 and 24 of the relay switch.

Figure 1:
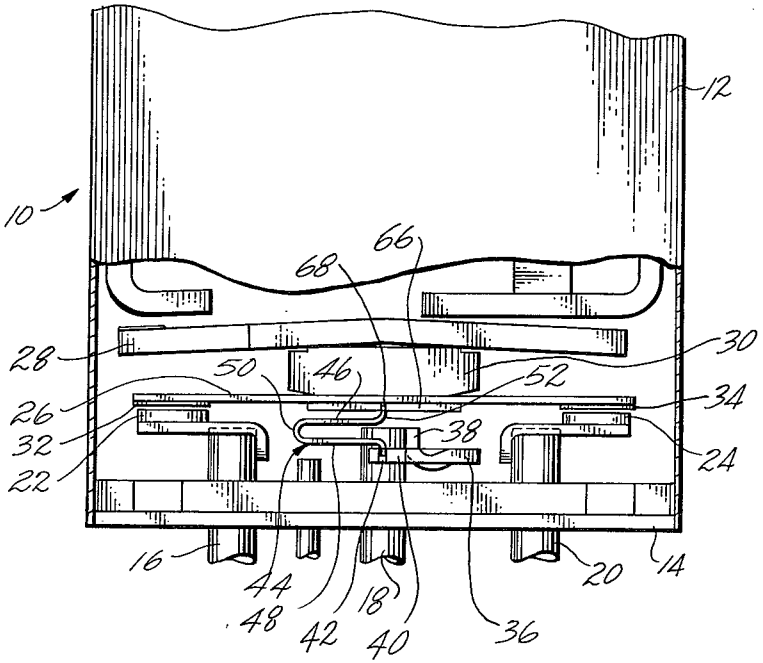
FIG. 1 is a partial side elevational view of a relay incorporating the present invention.
Figure 3:
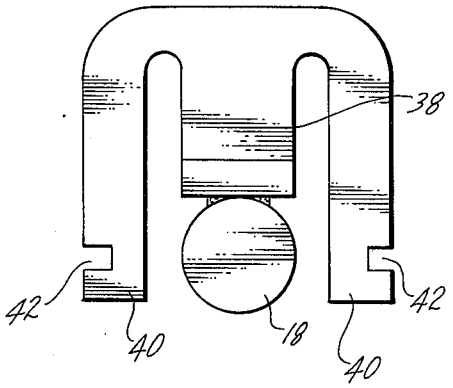
FIG. 3 is a detailed view of the contact bracket.

The relay switch includes one or more moving contact blades 26. The relay is shown in FIGS. 1 and 2 as a three-pole double-throw switch incorporating three moving contact blades 26. The contact blades 26 are mounted on the armature of the relay, indicated at 28, by means of an insulating mounting block 30, in the manner described in detail in copending application Ser. No. 691,003, filed May 28, 1976, entitled "Switch Mounting Assembly for an Electromagnetic Relay", and assigned to the same assignee as the present invention. The outer ends of the contact blade 26 terminate in moving contacts 32 and 34 positioned opposite the fixed contacts 22 and 24, respectively. Rotation of the armature assembly by the relay opens and closes the respective sets of contacts.

To provide an electrical connection between the moving blade 26 and the center contact pin 18, a generally E-shaped bracket 36 is provided. The bracket includes a center leg 38 and a pair of outer legs 40. The center leg 38 is bent through a double curve, as shown in FIG. 1, so that the end of the center leg extends substantially perpendicular to the outer legs 40. The center leg 38 is spot-welded or otherwise secured to the side of the pin 18 with the outer legs 40 stradding the pin 18 on either side. The legs 40 thus extend parallel to the header 14 intermediate the header 14 and inner end of the associated contact pin 18. The ends of the outer legs 40 are provided with notches 42 which are aligned along a common axis passing through the center of the associated contact pin 18.

Figure 4:
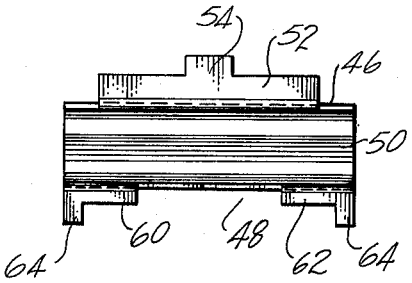
FIGS. 4 and 5 are detailed views of the U-shaped contact spring of the present invention.
Figure 5:
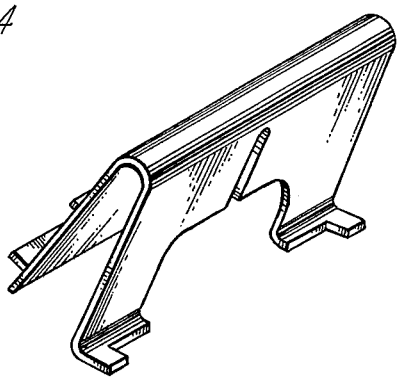

An electrical current path is provided between the bracket 36 and the blade 26 by a U-shaped spring 44. The U-shaped spring includes two parallel legs 46 and 48 joined by a bight portion 50. As thus seen in FIGS. 4 and 5, the outer end of the upper leg 46 is formed with an outwardly projecting lip 52. The edge of the lip 52 includes a projection 54. The lower leg 48 is bifurcated by a slit 56 which widens into an open slot 58. Thus the leg 48 is divided into two end portions with outwardly projecting lips 60 and 62. The lips are formed with projections 64 at the outer edges thereof.

The U-shaped spring 44 is positioned with the pin 18 extending through the slot 58. The outer edges of the lip 60 and 62 engage the top surface of the outer legs 40 of the bracket 36 with the projections 64 engaging the notches 42. Similarly the lip 52 of the upper leg 46 engages a clamping plate 66 which clamps the contact blade 26 against the block 30. The clamping plate 66 has a notch 68 which receives the projection 54 of the lip 52. The ends of the U-shaped spring 44 tend to spring apart, thereby holding the edges of the lips 52, 60, and 62 respectively, against the surface of the clamping plate 66 and the surface of the bracket 36.

The arrangement as described permits the contact pin 18 to be aligned with the center of the moving contact blade 26 and at the same time permits extremely close spacing between the inner end of the contact pin 18 and the moving contact blade 26. Thus the arrangement of the present invention results in an extremely compact relay design in which spacing between the parts of the switch can be maintained to very close dimensions. This is done without shortening the pin. If the pin is made too short, the bracket cannot be welded to the pin without danger of cracking the glass seal in the header. What is claimed is:

1. In a relay apparatus for completing an electrical circuit to the moving contacts supported on a pivoted contact blade means comprising a header having at least one connector pin extending therethrough, an E-shaped bracket having the center leg attached to and supported by the connector pin, the outer legs extending perpendicular to the pin on either side, and a U-shaped spring member having one leg bifurcated with the ends turned outwardly, the outwardly turned ends engaging the outer legs of the E-shaped bracket on either side of the pin, the outer leg of the U-shaped spring member having an outwardly turned end adapted to engage the contact blade means opposite the end of the pin.

2. Apparatus of claim 1 wherein the center leg of the E-shaped bracket is bent such that the outer end extends perpendicular to the outer legs, the outer end being attached to the side of the pin.

3. Apparatus of claim 1 wherein the outwardly turned ends of the bifurcated leg of the U-shaped spring having projections thereon, the outer legs of the bracket having notches for receiving said projections.

4. Apparatus of claim 1 wherein the longitudinal axis of the pin and the pivot axis of the contact blade means are perpendicular to each other and lie in a common plane.

5. Apparatus of claim 1 wherein the distance between the end of the pin and the adjacent contact blade means is less than the spacing between the legs of the U-shaped spring when assembled, the pin extending between the bifurcated ends of the one leg of the U-shaped spring.

* * * * *